United States Patent [19]

Kaftan

[11] Patent Number: 4,819,295

[45] Date of Patent: Apr. 11, 1989

[54] SLIDING SCREEN CLOSER

[76] Inventor: John A. Kaftan, Jordan Heights Rd., DePere, Wis. 54115

[21] Appl. No.: 177,220

[22] Filed: Apr. 4, 1988

Related U.S. Application Data

[63] Continuation-in-part of Ser. No. 895,000, Aug. 7, 1986, abandoned.

[51] Int. Cl.[4] ..... E05F 1/08

[52] U.S. Cl. ..... 16/72; 16/71; 16/85

[58] Field of Search ..... 16/63, 71, 78, 72, 82, 16/83, 85, 86 R, 86 A, 86 B, 86 C

[56] References Cited

U.S. PATENT DOCUMENTS

| | | | |
|---|---|---|---|
| 3,143,773 | 8/1964 | Glenn | 16/73 |
| 3,160,250 | 12/1964 | Bridwell | 16/78 |
| 3,389,422 | 6/1968 | Glenn | 16/78 |
| 4,003,102 | 1/1977 | Hawks et al. | 16/72 |
| 4,004,372 | 1/1977 | Beard et al. | 16/72 |
| 4,126,912 | 11/1978 | Johnson | 16/81 |
| 4,301,623 | 11/1981 | Demukai | 16/82 |
| 4,330,960 | 5/1982 | Hasemann et al. | 16/78 |

FOREIGN PATENT DOCUMENTS 2001678 7/1971 Fed. Rep. of Germany .

*Primary Examiner*—Richard K. Seidel
*Attorney, Agent, or Firm*—Francis J. Bouda

[57] ABSTRACT

A door closer for a sliding screen or door which can be vertically mounted on the vertical non-movable frame of a doorway. A tension cord extends inwardly from the door-opening to be secured to the inboard end of a sliding screen or door whereby automatically to pull the screen or door across said opening. The closer does not obstruct the opening when said screen or door is in open position.

2 Claims, 1 Drawing Sheet

SLIDING SCREEN CLOSER

This application is a continuation-in-part of application Ser. No. 895,000 filed Aug. 7, 1986, now abandoned.

BACKGROUND OF THE INVENTION

In large patio doors or doors which are held in a large frame and adapted to slide sideways in the door opening, the door is quite often left open, and in insect-infected areas it is necessary to have a sliding screen arranged to close the opening after the sliding door has been opened.

A number of inventors have directed their attention to solving the problem of keeping the door closed, and I refer particularly to U.S. Pat. Nos. 3,160,250; 4,003,102; 4,004,372; 4,126,912; 4,301,623; and 4,300,960; as well as the German Offenlegungsschrift No. 2 001 678.

In all of these door-closing devices (some of which were adapted automatically to close a thick, heavy safety door or a fire door in an industrial installation), the closing mechanism operates on either the top or the bottom of the screen or door to be automatically closed. In large and heavy doors, this presents no problem, but in lightweight screens constructed primarily for use in patio doors or similar doors in private homes or non-institutional areas, if the screen or closing member is not pulled directly at the approximate vertical center of the door, it tends to "cock" in the frame and resists the easy sliding or closing thereof.

All of the inventions of the prior art are thus defective or impractical for use in lightweight screens or patio doors, or the like, and my invention has overcome this problem, inasmuch as the operating forces all act upon the center portion of the door, and thus permit easy sliding of the door back and forth in the horizontal upper and lower tracks which guide and hold the screen in place.

SUMMARY OF THE INVENTION

The screen closure of the present invention includes a hollow, tubular holder which is mounted on the inboard, vertical portion of the frame of the door, with a spring-loaded cord which can be pulled horizontally therefrom and attached to the inboard edge of the screen or sliding portion, which is to be automatically pulled across the opening of the doorway. The assembly of the cord, spring and pulleys provides a block-and-tackle arrangement within the holder, and affords a cord of sufficient length to reach completely to the distant inboard edge of the screen when the screen is in fully open position. When the pushing force on the screen (created by the person opening the screen) is released, the tension of the spring, block-and-tackle, and cord acts directly on the center of the vertical inboard edge of the screen and pulls the screen across the opening of the door.

None of the devices of the prior art would be effective in this manner, because if they were mounted on the outboard frame of the door opening, the cord which draws the screen into the closed position would pass directly across the middle portion of the open doorway and prevent passage therethrough.

Thus, for the first time, there is provided a closing mechanism which properly operates and applies its forces at the centerline of a doorway, without obstructing the opening with its own mechanism, and which permits the easy and proper sliding-action of the door and prevents the "cocking" and "jamming" of the frame of the screen within the doorway.

Therefore, a principal purpose of the present invention is to provide a screen closer constructed and arranged to act upon the vertical centerline of a sliding screen or door.

A further purpose of the present invention is to provide a mechanism for easy closing of a lightweight screen in a doorway or similar opening.

Still another object of the present invention is to provide a screen-closer which is easy to mount on existing doorways, and which does not obstruct entrance to the doorway when the screen is open.

An additional object of the present invention is to provide an adjusting feature which permits the closing device to operate at different speeds and thus provide for either fast or slow closing of the screen door.

Further objects of the present invention are to provide a mechanism which automatically closes a screen door, fits a variety of door sizes, is adjustable in tension, stabilizes flimsy screens, extends the life of frame and screen, locks in open position, and can be easily installed.

With the above and other objects in view, more information and a better understanding of the present invention may be achieved by reference to the following detailed description.

DETAILED DESCRIPTION

For the purpose of illustrating the invention, there is shown in the accompanying drawings forms thereof which are at present preferred, although it is to be understood that the several instrumentalities of which the invention consists can be variously arranged and organized and that the invention is not limited to the precise arrangements and organizations of the instrumentalities as herein shown and described.

In the drawings, wherein like reference characters indicate like parts:

FIG. 1. is a perspective view of the screen closer of the present invention mounted on a sliding screen in a patio door.

Figure 1:
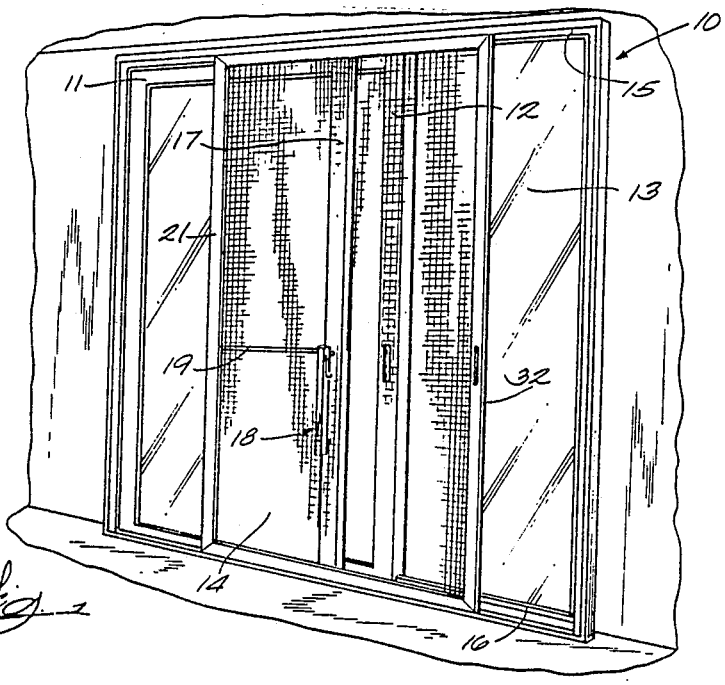

In FIG. 1, I have shown a patio door 10 which has a fixed portion 11 and a sliding portion 12. The sliding portion 12 is adapted to be moved sideways so as to provide an opening 13 in the doorway.

A screen 14 is constructed and arranged to travel in a pair of tracks, one being the upper track 15 and the other being the lower track 16, so as to slide across the opening 13 when the door 12 is both open and closed, but also to slide across the fixed portion 11 when moved sideways by a person desiring to pass through the door.

The non-moving vertical portion 17 of the fixed member 11 provides the in-board edge of the doorway opening, and it is to this portion 17 that the closer 18 of the present invention is attached.

A cord 19 which extends from the closer 18 has a hook 20 at its outer end, and this hook is intended to be secured to the inboard vertical edge 21 of the screen 14.

Tension on the cord 19, created by the spring 22 in the closure 18, causes a drawing force on the cord 19 to exert a closing force on the vertical edge 21 of the screen 14, and to move it in the tracks 15 and 16 across the opening 13 when the pushing force created by the person passing through the door is released.

Thus the tension in the cord 19 acts on the vertical center of the screen and prevents the screen from "cocking" or jamming in the tracks 15 and 16.

More importantly, the positioning of the closer 18 on the identical member 17 puts it out of the way of the opening 13 and eliminates any closing mechanism from obstructing the opening 13.

The closer 18 is a generally tubular member which can be either circular or rectangular in cross section, and which has disposed therein a spring 22 fastened at its bottom 23 to the housing 24.

The upper end 25 of the spring 22 is secured to a pulley 26 which is fastened through the block and tackle arrangement 27 to the upper pulley 28.

The cord 19 of the block and tackle 27 extends horizontally through the opening 29 so that it can be pulled horizontally to enable the hook 20 to be connected to the inboard vertical edge 21 of the screen 14.

A separate chain 30 having a hook 31 at its end may be provided on the outside of the body member 24 so that the hook 31 may be placed around the outboard vertical edge 32 of the screen 14, when the screen is in open position so as to hold the screen in open position against the tensioning forces on the cord 19 if it is desired to hold the screen permanently in open position.

The cord 19 is made of long-life material, such as dacron, and the housing of the closer can be made of aluminum or plastic with stainless steel parts, if desired, so that the device is weather-resistant and long-lasting.

If desired, a knot 33 can be tied in the cord 19 so as to adjust the tension of the cord 19 to the requirements of the sliding screen to which the closer is attached.

The closer body 24 can be fastened to the vertical portion 19 of the non-movable frame, either with double-sided adhesive tape or appropriate bolts, or screws, or in any other manner well-known in the art.

Figure 3:
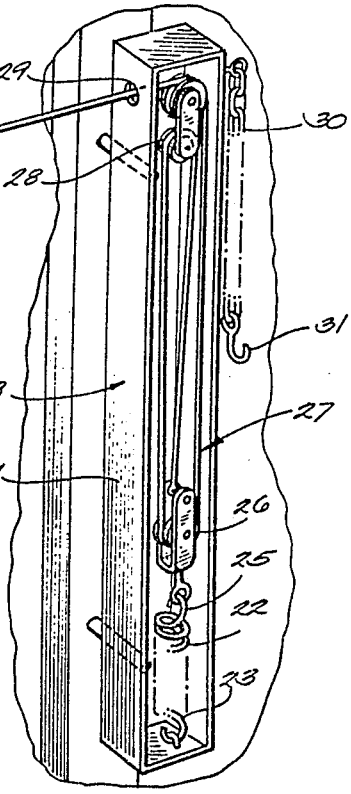
FIG. 3 is a perspective view of the fragmentary upper portion of another modification of the door closer of the present invention.
Figure 3:
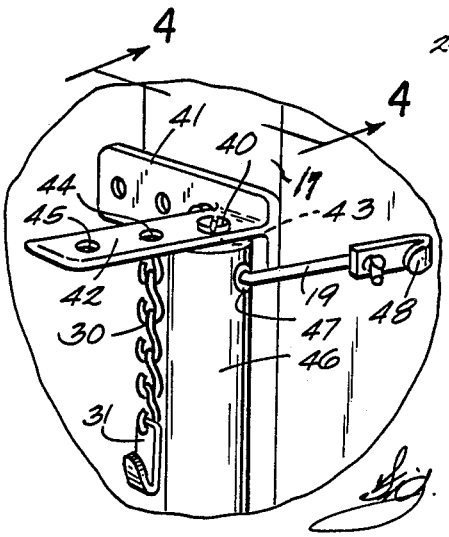
Figure 4:
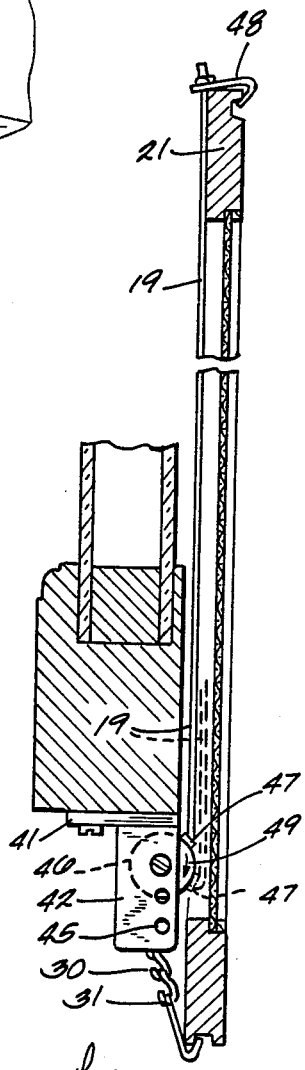
FIG. 4 is a vertical cross-sectional view taken generally along line 4—4 of FIG. 3.

In FIGS. 3 and 4, I have shown a modification of the closer of the present invention which includes a tubular housing 46 which can be mounted by the screw 40 on the bracket 41. The bracket 41 is intended to be secured to the inboard vertical edge 17 of the fixed member 11.

In FIG. 3 I have shown the tube 46 mounted by the screw 40 in the inner-most hole 43 of the bracket portion 42. Additional holes 44 and 45 may be positioned in the bracket 42 if it is desired to mount the tube 46 at some distance from the surface of the vertical portion 17.

As can be seen particularly in FIG. 3, the opening 29 in the tube 46 has a grommet 47 fitted within the opening, and the cord 19 is drawn through the grommet by the hook 48.

Figure 2:
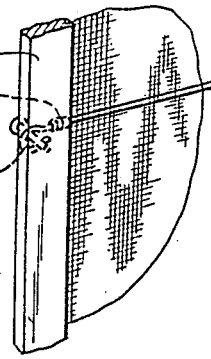
FIG. 2 is a perspective view of the door closer shown in section so as to illustrate the internal mechanism thereof.

When the tube 46 is fastened securely by the screw 40 in the hole 43 of the bracket 42 in the angular position shown in FIG. 4, the cord 19 can be drawn easily through the grommet to its extended position at the outboard end of the screen (as is shown in FIG. 2 or in FIG. 4).

Then when the opening force on the screen is released, the tension on the spring 22 easily pulls the cord back through the grommet 47 into the tube 46 and the screen door is rather rapidly returned to its closed position.

However, if the tube 46 is rotated in the direction of the arrow 49, as shown in FIG. 4, (approximately 90 degrees or more) the cord is caused to pass through the grommet 47 at a sharp angle, and this causes friction between the grommet 47 and the cord 19, and the spring-loaded forces within the tube 46 cannot as effectively draw the cord inward. Therefore, the action on the screen door is less forceful and the door is returned to its closed position more slowly than if the grommet 47 were in the original position shown in solid lines in FIG. 4.

When mounting the tube 46 on the bracket 42, the screw 40 is tightened sufficiently to prevent the tube from rotating in relation to the bracket 42. However, this force can be overcome manually by twisting the tube 46 against the restraining action of the screw 40 and bracket 42.

This single adjustment of the friction forces acting on the cord 19 make it easy to change the speed with which the screen door will be closed. This is particularly critical if, for instance, the people passing through the door are of different ages. If there are a lot of children in the house and the door is opened and closed often, it is desirable to have the fast-acting effect on the door so that the door closes quickly. Thus it is desirable to have the tube adjusted to the position shown in solid lines in FIG. 4.

On the other hand, if elderly people often use the passageway, it is desirable that the screen door does not close so quickly, and a simple turning of the tube 46 against the action of the screw 40 and bracket 42 increases the friction on the cord and prevents the door closing faster than is desirable when an elderly person is passing therethrough.

It is to be understood that the present invention may be embodied in other specific forms without departing from the spirit or special attributes hereof, and it is therefore desired that the present embodiments be considered in all respects as illustrative, and therefore not restrictive, reference being made to the appended claims rather than to the foregoing description to indicate the scope of the invention.

Having thus described my invention, what I claim as new and desire to protect by Letters Patent are the following:

1. A device for closing a door-opening, said device including a sliding screen or door having an inboard vertical member and an outboard vertical member, said door-opening including a frame having a vertical non-movable inboard member, a closer for said door, including a vertically mountable housing containing a spring-tensioned block-and-tackle arrangement, a cord connected to said block-and-tackle arrangement, said cord arranged to extend horizontally from said closer, a hook adjustably secured to said cord whereby the spring-tension can be increased or decreased depending upon the position of said hook, means for mounting the closer in a generally vertically central portion of the non-movable inboard member of the door frame with the cord and hook extending away from the door-opening so that the hook can engage the inboard vertical member of the door or screen, said housing including an adjustable support whereby to speed up or slow down the closing of the door by rotating the housing in relation to the support, whereby the closer can move the door across the door-opening without said cord obstructing said door-opening when the screen or door is in an open position.

2. The door-closing device of claim 1 wherein said housing has an opening through which the cord passes and which acts upon the cord with more or less friction depending on the rotational position of the housing.

* * * * *